United States Patent [19]

Wells et al.

[11] Patent Number: 4,860,531

[45] Date of Patent: Aug. 29, 1989

[54] RACQUET STRINGS

[76] Inventors: D. Phillips Wells; Stephen R. Phelps, both of P.O. Box 10191, Naples, Fla. 33941

[21] Appl. No.: 133,756

[22] Filed: Dec. 16, 1987

[51] Int. Cl.[4] ..... D02G 3/34; D02G 3/44; D02J 1/00

[52] U.S. Cl. ..... 57/234; 57/7; 57/232; 57/248; 57/251

[58] Field of Search ..... 57/210, 219, 223, 225, 57/232, 234, 241, 243, 248, 250, 251, 258, 7, 138

[56] References Cited

U.S. PATENT DOCUMENTS

| | | | |
|---|---|---|---|
| 1,773,969 | 8/1930 | Dreyfus | 57/248 X |
| 2,401,291 | 5/1946 | Smith | 57/140 |
| 3,023,483 | 3/1962 | Steiner | 28/81 |
| 3,738,096 | 6/1973 | Crandall | 57/149 |
| 3,745,756 | 7/1973 | Crandall | 57/149 |
| 4,055,941 | 11/1977 | Rivers, Jr. et al. | 57/149 |
| 4,084,399 | 4/1978 | Kanemura et al. | 57/232 |
| 4,183,200 | 1/1980 | Bajaj | 57/234 |
| 4,275,117 | 6/1981 | Crandall | 428/373 |
| 4,297,835 | 11/1981 | Shimizu | 57/251 |
| 4,306,410 | 12/1981 | Nakamura et al. | 57/234 |
| 4,320,791 | 3/1982 | Fujii et al. | 57/241 X |
| 4,395,458 | 7/1983 | Huang | 57/258 X |
| 4,660,364 | 4/1987 | Chiang | 57/234 |

OTHER PUBLICATIONS

Vol. II, No. 3, "The Stringer's Assistant", Mar. 1987, U.S. Stringer'Assoc., Del Mar, Calif.

Leoina TM Square Shaped String Advertisement, p. 34, Oct. 1988, "Tennis Buyer's Guide".

*Primary Examiner*—Donald Watkins

*Attorney, Agent, or Firm*—Warren L. Franz

[57] ABSTRACT

A synthetic string for a sports racquet has an inner single strand or multifilament core, wrapped with one or more helically wound layers of large diameter strands of monofilament, and surrounded by an extruded coating of regular polygonal cross-section having 5 to 8 planar surfaces joined at parallel, axially extending biting edges which serve to impart greater topspin and slice control to the ball.

10 Claims, 2 Drawing Sheets

FIG. 1
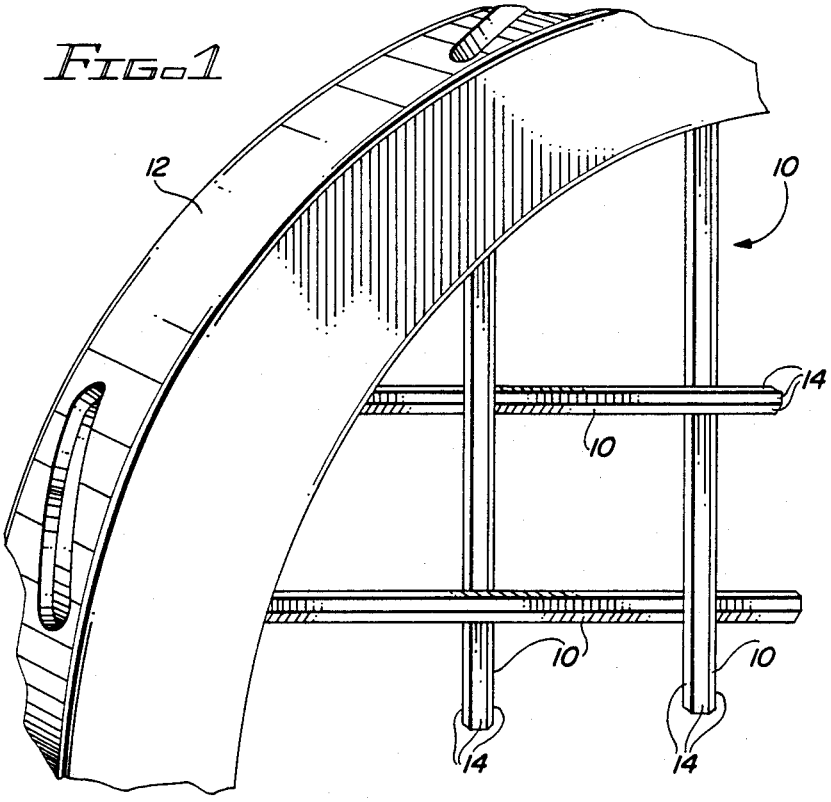
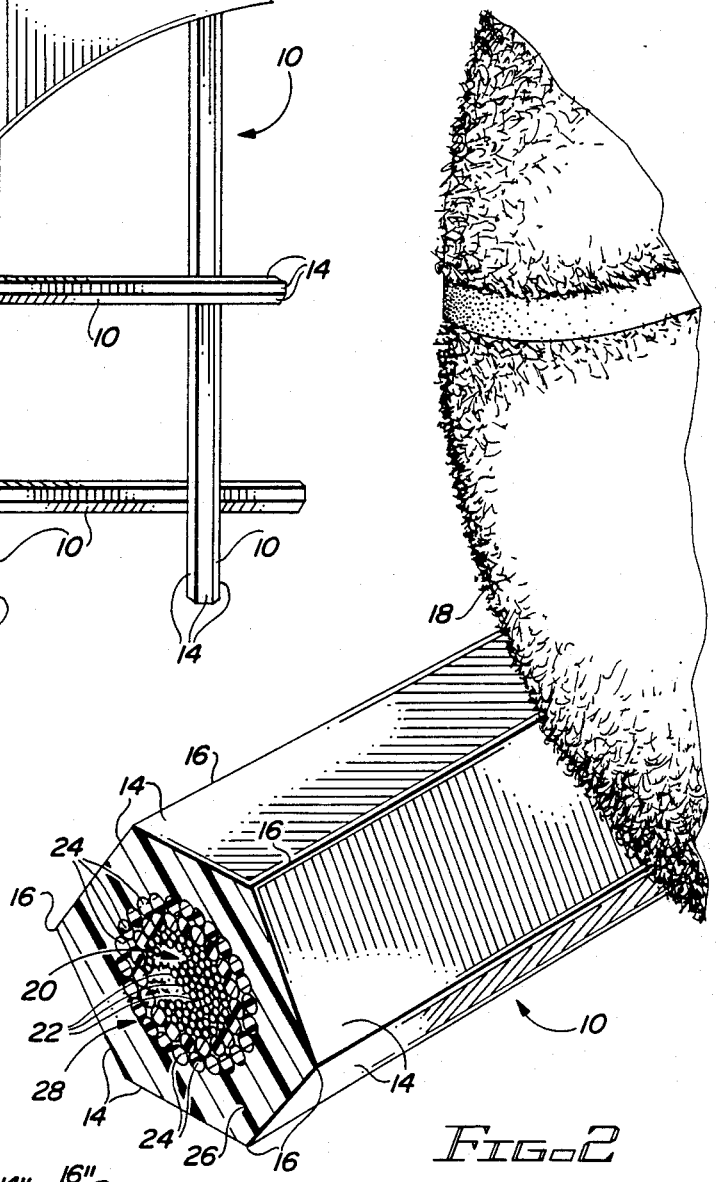
FIG. 2
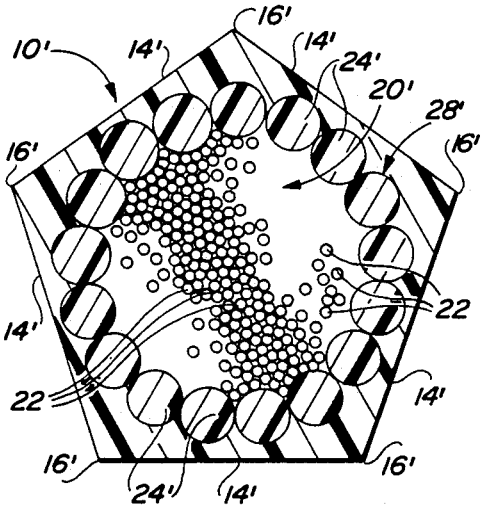
FIG. 3
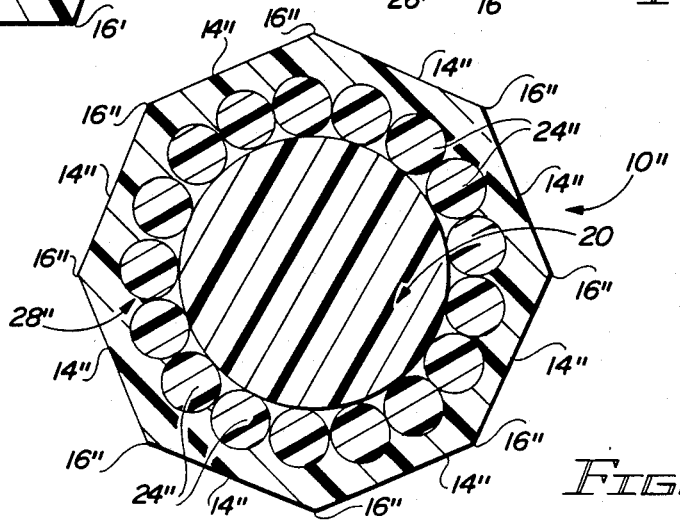
FIG. 4

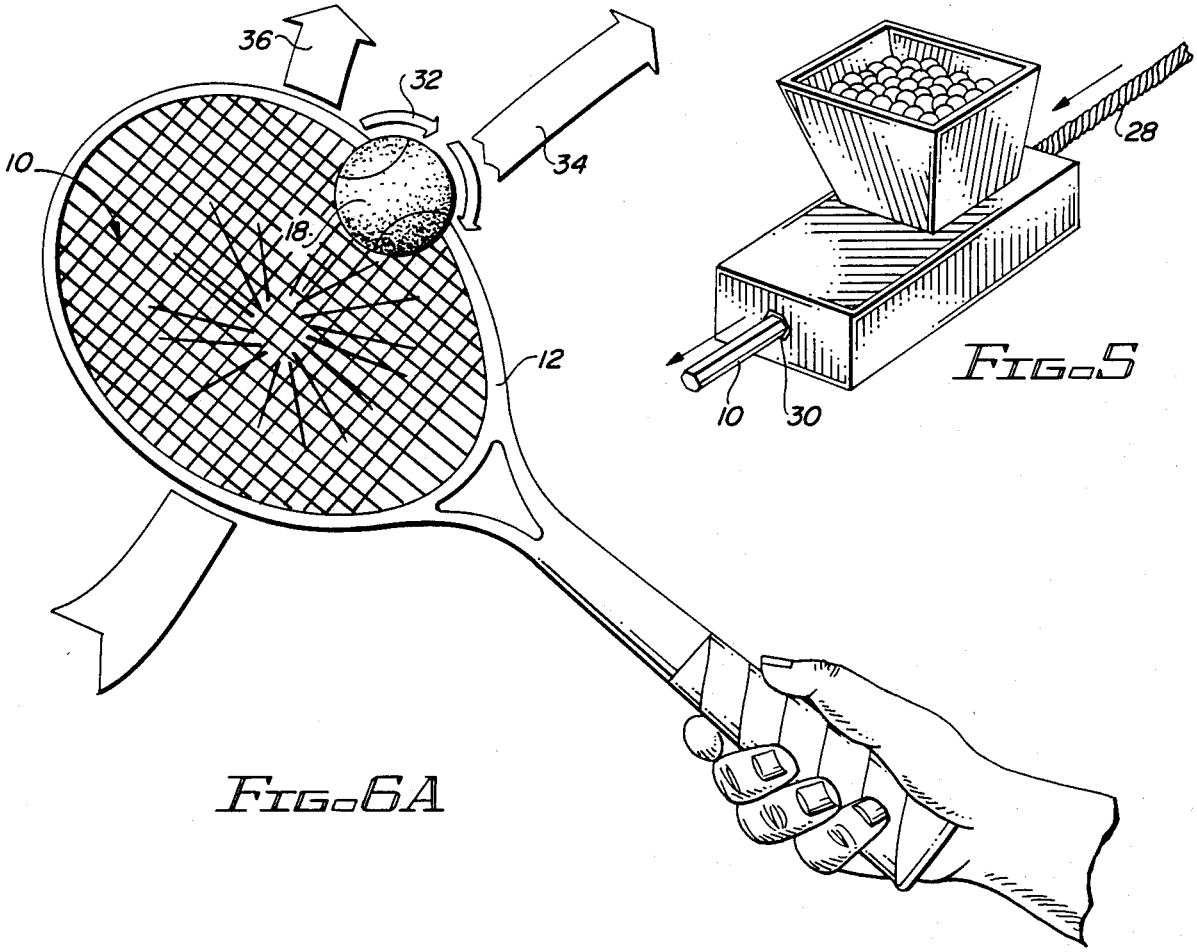
FIG. 6A
FIG. 5
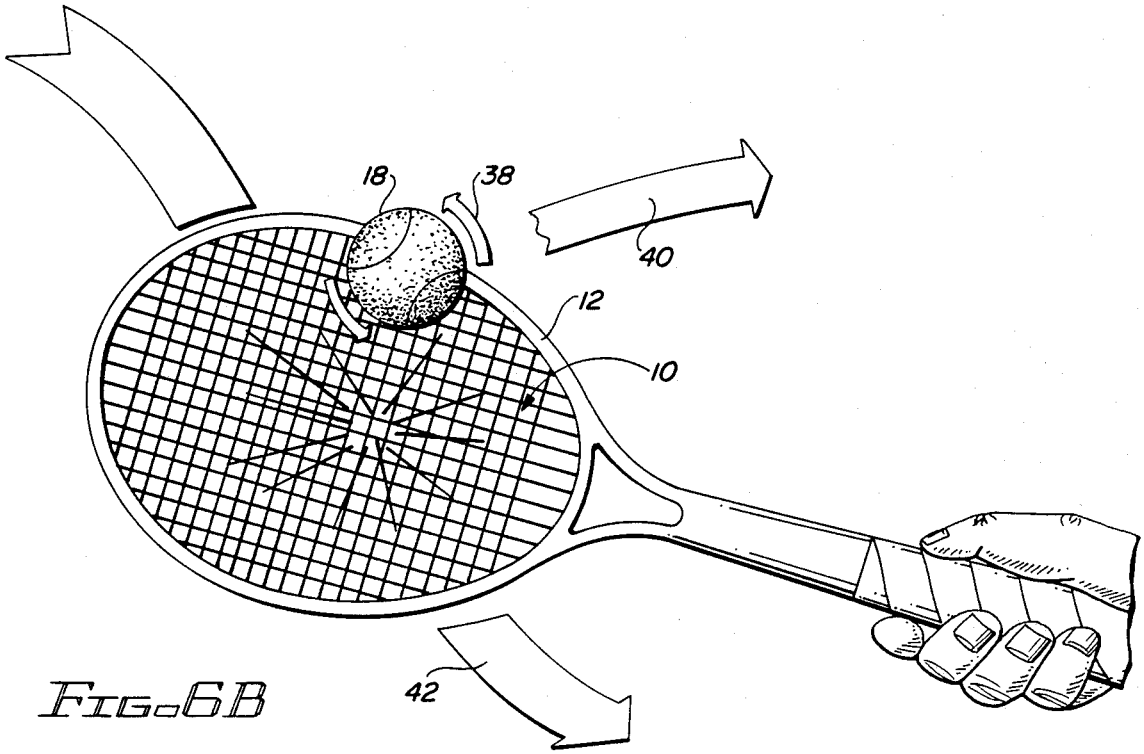
FIG. 6B

RACQUET STRINGS

The present invention relates to sports racquet string construction and, more particularly, to a synthetic racquet string featuring an external surface having five or more planes. The edges of these several planes, upon contact with the sports ball or other playing object, allow the player to impart more of the desired effects of either "topspin" or "slice".

BACKGROUND OF THE INVENTION

In the early days of racquet sports, the traditional material used to string sports racquets was a natural gut material made from animal fibers. In the sport of tennis, players found that natural gut was an acceptable material because of its good tensile modulus which produces an excellent combination of elasticity and resiliency. The desirable tensile modulus found in natural gut has been attributed, at least in part, to its multiple fiber construction. Natural gut remains one of the most favored strings for use in tennis sports today.

However, natural gut has some drawbacks and these disadvantages have traditionally discouraged its universal use. For example, it is adversely affected by humidity, frays easily and is not considered very durable. Additionally, the available amount of raw material is limited. Furthermore, it is difficult to produce strings with a constant modulus property because of the varying character of the raw material. All these factors tend to make the natural gut strings very expensive to produce, and price has inhibited widespread use, especially with beginning and intermediate level players.

In the past several years, there has been a tremendous rise in popularity of racquet sports. This has led manufacturers to seek alternatives to natural gut which would be easier and less expensive to produce. Fortunately, the development of synthetic fibers has supported the creation of different synthetic strings. Synthetic strings are made in single-strand coreless construction and in composite integral structures having an internal central core. The central core typically consists of a large diameter single strand or fiber bundle core, wrapped with one or more layers of strands, helically wound and bonded to form a sheath around the core. The wrapped core is then encased in an integral compatible plastic coating.

Such synthetic strings offer the advantages of lower cost of production, good durability, and generally humidity resistance. There are many variations in the way synthetic strings are made as evidenced by the patents ranted in this field. Because of the development of new fibers, bonding agents and manufacturing techniques there is a continuing need for new and improved sports racquet strings made from synthetic materials.

Although sports racquet strings made from synthetic materials constitute the vast majority of today's market, synthetic fiber strings are quite often excessively smooth in their outer surface and are deficient in the extent to which they are able to frictionally engage the ball or other playing object. This results in a dull trajectory and ball control difficulty, especially with maneuvers such as the application of "topspin" or "slice." In order to produce better frictional engagement with the ball and to prevent the ball from "slipping" off the smooth surface of the strings, various countermeasures have been utilized—roughening the outer surface of the string by grinding with abrasives, surface coating the string with frictional or rubbery substances, twisting or braiding the synthetic fiber multifilaments, as well as many other proposals.

Synthetic strings produced in such manner tend to have poor dimensional stability and are reduced in the stiffness and the limit of elasticity to result in tension loss during play. Further, they are inferior in durability because they often exhibit surface aberrations, wearing or breakage due to degradation of the resin, and abrasion, peeling or denaturing of the treating substances. Moreover, since the above-mentioned treatments constitute additional steps, there is an increase in production costs.

A somewhat improved string construction has been suggested which is created by wrapping a nylon monofilament or spaced spiral wrap helically around the outer circumference. Several versions of this type of construction are in use; however, they have not captured widespread appeal since they are difficult to install in racquet frames and tend not to play too well.

Because of the shortcomings inherent in the various attempts to create a synthetic string with more friction, most sports racquets are strung with synthetic strings that have a round profile. Besides the amount of friction a string may have with the ball, there are certain other properties any string should ideally have, depending upon the particular racquet sport, which will affect the string's performance under playing conditions. For instance, there is a particular percentage range or elongation and a particular percentage of resiliency it should have; a minimum amount of tensile strength and knot strength; etc. Within the basic parameters many types and brands of successful strings have been produced, marketed and used in the different racquet sports.

For the sake of explanation, it has been found that in the game of tennis there should be enough elongation so that, upon impact, the ball would be "cupped" in the string bed, that is, in the area within the head of the racquet where the strings are installed in any of several crisscross patterns. This "cupping" of the ball allows the ball to remain on the string bed for a fraction of a second longer and the player is able to impose more control over the direction in which he can return the ball, and he may also impose the effect of "top-spin" (in which the ball leaves the string bed spinning forward, or in the direction of its trajectory), or the effect of "slice" (in which the ball leaves the string bed spinning backward, or in the direction opposite to its trajectory).

These effects, topspin and slice, have become important factors in the games of a great number of tennis players in the intermediate, advanced and professional levels of play.

The way in which topspin is produced is by impacting the ball obliquely in a direction beginning with the racquet frame head below the ball and continuing at an angle carrying the racquet forward and upward. The dynamics of this type of stroke have the effect of producing friction between the string bed and the ball's surface, causing the ball to leave the string bed spinning forward on axis as well as moving forward physically.

The benefit of the topspin effect is that the ball can be hit much higher since, at its apex, the aerodynamics of its rotation will cause it to drop downward more sharply, and upon impact with the court surface, to bounce high and away, much more than a ball with no spin.

An opponent player, stationed at the net in the middle of the court, may easily be able to reach and return a ball hit with no spin; however, the high trajectory of a ball with a good degree of topspin may be too high for him to reach, yet will fall safely within the playing limits of the court.

The method by which slice is produced is by impacting the ball obliquely in a direction beginning with the racquet frame head .above the ball and continuing at an angle carrying the racquet forward and downward. The dynamics of this stroke have the effect of producing friction between the string bed and the ball's surface, causing the ball to leave the string bed spinning in reverse direction to its axis as well as moving forward physically.

The benefit of the slice effect is that the ball tends to drop to the court surface sooner and, upon impact, bounce with less height but with more speed, than a ball hit with no spin.

An opponent player has much more difficulty returning a ball with slice than one with no spin because the sliced ball travels lower, dips to the court surface faster and bounces lower and faster than a ball hit with no spin.

Historically, players have learned the benefits of these effects and many have incorporated one or both into their daily playing techniques. Several years ago, tennis professional Bjorn Borg became successful using large amounts of spin in his play. This was quickly copied by other tennis players with increased enthusiasm, so that an increased awareness of both "topspin" and "slice" swept through the tennis profession.

Tennis companies, wishing to capitalize on this interest, began producing "rough" strings in various ways which, they hoped, would allow the player to enhance whatever amount of topspin or slice he or she could impart on the ball. A typical example, already mentioned, was to provide ordinary round strings with an extra monofilament spiral glued in place around the strings in the hope that the resulting roughness would have the desired effect. There are several limitations to this technique—the extra monofilament spiral made the string difficult to install in the racquet causing widespread dissatisfaction among stringers; the extra monofilament was difficult to glue and often would break free of the base string; and usually this type of string was a simple, low-technology monofilament which lacked the inherent properties necessary for good play.

Players made their own modifications, using sandpaper to roughen the surface of their strings to allow them to "bite" the ball surface more. Stringers, too, became involved. A type of stringing, called "spaghetti stringing," was developed which employed incorporation of foreign materials (knots, etc.) in the string bed. In short, tennis players have been searching for physical changes in the surface of regular round strings by which they can enhance the effects of both topspin and slice.

Although a certain measure of success has been achieved with the foregoing spin performance increasing methods, there remains a demand for a "rough" string which offers the inherent properties for good play, is as easy to install as ordinary round string, and which allows the player to greatly enhance the effects of topspin and slice. It is an object of the present invention to provide such a string.

SUMMARY OF THE INVENTION

In accordance with the invention, a synthetic sports racquet string is provided that has an outer surface of multiplanar configuration presenting parallel, axially extending biting edges that serve to frictionally engage a ball or other playing object to provide improved topspin and slice control.

In a preferred embodiment, described in greater detail below, a string having a conventional spirally wound monofilament core is provided with an extruded coating of synthetic material that establishes an outer surface of the string having a regular hexagonal cross-section.

BRIEF DESCRIPTION OF THE DRAWINGS

Embodiments of the invention have been chosen for purposes of illustration and description, and are shown in the accompanying drawings wherein:

FIG. 1 is a perspective fragmentary view of a sports racquet strung with a string in accordance with the present invention;

FIG. 2 is an enlarged cross-section view of a preferred form of the string of FIG. 1;

FIGS. 3 and 4 are cross-section views of alternate forms of the string of FIG. 1;

FIG. 5 is a view of the extrusion step in the manufacture of the string of FIG. 1; and FIGS. 6A and 6B are schematic views useful in understanding the operation of the string of FIG. 1.

Throughout the drawings, like elements are referred to by like numerals.

DETAILED DESCRIPTION OF PREFERRED EMBODIMENTS

As shown in FIG. 1, a string 10 embodying the principles of the present invention is shown strung onto the frame of the head of a sports racquet 12. The string has an outer surface with a plurality of planar surfaces 14 (FIG. 2), the respective junctions of which provide projecting parallel, axially extending edges 16 that are brought into contact during play with the external surface of a playing object, such as a tennis ball 18, to impart top spin or slice effects thereto.

The string 10 in the example shown in FIG. 2 is of regular polygonal cross-section, presenting six planar surfaces 14 which respectively intersect at 120° angles to present six biting edges 16. As shown in FIG. 2, the exemplary string 10 is made of synthetic material and is of composite construction having an inner core 20 comprised of a multiplicity of small diameter monofilament fibers or strands 22 which are twisted and glued to form the central structure. The core 20 is wrapped with one or more layers, helically wound in opposite directions, of larger diameter strands 24, and coated with a synthetic coating 26 to provide a unitary construction with outer faces forming the planes 14 and ridges or peaks forming the edges 16.

The internal structure of the string can be constituted employing any of various well-known techniques. A suitable specific exemplary construction has a core 20 composed of 700 or more strands 22 of nylon fiber which are twisted and glued, such as with a glue composition of nylon, phenol and trichloroethane. The combined fiber is then cured at elevated temperature, such as at 150° C. for 2 minutes. The cured core 20 is then helically wrapped in one direction with a first layer of 18 larger nylon monofilament strands 24 which are twisted and glued; and, then, similarly helically wrapped in the opposite direction with a second layer of 20 strands 24. The result is a combined wrapped core 28 which is then likewise cured. The resulting wrapped strand 28 is then processed with a coating glue and passed through a die 30 (FIG. 5) in which a nylon coating of hexagonal extrusion is applied to the wrapped core, and then cooled with water at reduced temperature of, say, 10° C. The finished string 10 can then, optionally, be further processed such as for moisture control, such as by winding the product on an aluminum roll and placing it in a boiler at 100° C. for several hours.

The number of twists per centimeter given to the strands 22 and 24 is chosen to suit the characteristics desired for the resulting string. The thickness of the coating will depend on the dimensions of the coating die or mold 30 through which the string is passed. The diameter of coating 26 in FIG. 2 is shown exaggerated for clarity. A suitable coating may be achieved which has a diameter not too much greater than the diameter of the inner core 20. An acceptable string size has been made that has a diagonal measurement between opposite planar surfaces 14 of 15—L gauge, and between opposite edges 16 of 16—L gauge.

The internal string construction may be varied to suit individual manufacturing preferences. The above-described core make-up is similar to that used in the round string marketed by Adtek Sports under the trademark SOLID GOLD TM. It will be appreciated that solid coreless or single strand core constructions may also be employed. Strings can be cut to lengths of 36 ft. or other standard lengths as desired.

In practice, there may be some distortion of the cross-section as the string is passed through the die 30 (FIG. 5) due to flowing of the coating at the die exit point. And, while it is desirable, to achieve a uniform and regular cross-section, the important parameter is to achieve the plurality of planes 14 whose edge junctions will engage the ball 18 for imparting controlled movement thereto. The preferred cross-sectional configuration is a hexagonal one, as shown in FIG. 2. However, other planar arrangements which maintain distinct biting edges are also possible. And, while six edges is preferred, configurations of five, seven or eight edges are also workable.

FIGS. 3 and 4 show alternative embodiments of string 10 offering biting edges for enhancement of top spin and slice during play. FIG. 3 shows a string 10' having a cross-sectional shape in the form of a regular pentagon with planes 14' and biting edges 16'. The string 10' has a fiber bundle core as with string 10 (FIG. 2), but has only a single layer of core wrapping strands 24. FIG. 4 shows a string 10" having a cross-sectional shape in the form of a regular octagon with planes 14" and biting edges 16". The core 20" in FIG. 4 is constructed of a single large diameter monofilament strand. The different cross-section in the various embodiments is achieved in the coating process by differences in the shape of the die 30 through which the coating material is extruded (see FIG. 5).

For the same size outer diameter string, the hexagonal cross-section of FIG. 2 will permit a larger core than the pentagonal structure of FIG. 3. In other words, for the same size string, a hexagonal cross-section can have more core fiber than a pentagonal cross-section. This means less coating and more core fiber. The peaks of the hexagonal structure will thus offer greater bonding ability. The core fiber and thus the bite into the ball will be, thus, greater. The greater core is also available in the octagon configuration of FIG. 4; however, the projection of the edge 16" of string 10" is not a sharp and, thus, not as effective as that of string 10 of FIG. 2.

In trial plays with string in accordance with the invention, professional players have noticed a significant improvement in ball control resulting from a hexagonal cross-section, and have concluded that it is the sharp edges 16 where the planes 14 of the string meet that create the effect of both top spin and slice to such a degree.

The present invention can be incorporated in any size, gauge or geometry, produced in any appropriate material, and installed into any size, form or material of sports racquet for use in any of the several racquet sports. For purposes of this application, the exemplary configuration is that of a six-sided (hexagonal) sports racquet string constructed of nylon or other similar material, installed in a conventional midsize tennis racquet frame. Although this patent is intended to cover strings made of any appropriate materials used in any combination or used alone, the exemplary string features a core of fine fibers to achieve the desired playing characteristics and a thick outer coating to allow for the extruding in the hexagonal profile.

The exemplary racquet string shown in FIG. 1 is installed in one or more pieces in any of several appropriate criss-cross patterns under tension. In most sports racquets, the string is threaded through the racquet frame head which includes an outer surface which is oriented perpendicularly to the planar racquet opening. An inner surface defines the opening configuration. String is threaded through the racquet frame head between surfaces (see FIG. 1) which are formed through the racquet head in substantially radial orientations. In most cases, the string is oriented in cord lengths, with main strings running longitudinally (parallel to the handle) and cross strings running transversely.

The effect of installing string in this or similiar fashion is to create a suspended, tensioned grid of string with which to hit the ball. By installing strings with five, six, seven or eight planes, rather than in the usual round configuration, the edges of these planes are able to create more friction on the ball surfaces upon impact, thus allowing greatly enhanced top spin and slice imparted to the ball at the player's discretion.

As illustrated schematically in FIG. 6A, topspin in the direction of arrows 32 is imparted to the ball 18 by striking it obliquely with the strings 10 in the direction 34, moving the head of the racquet 12 from below the ball 18, forwardly and upwardly as shown by the arrow 36. Slice in the direction of arrows 38 is effected, as illustrated in FIG. 6B, by impacting the ball 18 in a direction 40, moving the racquet from a position above the ball 18, forwardly and downwardly as shown by arrow 42.

The invention provides an improved synthetic sports racquet string which offers good playing characteristics, is easy to install, and offers significantly better topspin and slice control. The invention has been described in the context of certain specific illustrative embodiments. It is to be understood, however, that various substitutions and modifications may be made to the above examples without departing from the spirit and scope of the present invention as defined by the claims appended hereto.

What is claimed is:

1. A synthetic string for a sports racquet, comprising:

an inner core of twisted and glued monofilament strands;

plurality of larger diameter strands helically wound about said inner core; and a coating of synthetic material surrounding and bonded to said core; said coating providing said string with an outer surface presenting five to eight planes extending circumferentially about said core, the respective junctions of which planes provide projecting parallel, axially extending biting edges peripherally of said string for frictional engagement with a ball or similar playing object to impart topspin and slice effects thereto.

2. A sports racquet having a frame head with an opening therein and a synthetic string mounted on said head to provide a suspended, tensioned grid over said opening for hitting a ball or similar playing object, said string comprising:

a core;

a coating of synthetic material surrounding and bonded to said core; said coating providing said string with an outer surface having five to eight planes extending circumferentially about said core, the respective junctions of which planes provide projecting parallel axially extending biting edges peripherally of said string for frictional engagement with said ball or similar playing object to impart topspin and slice effects thereto.

3. A string as in claim 2, wherein said planes are arranged so that said string has a regular polygonal cross-section.

4. A string as in claim 3, wherein said string has a regular hexagonal cross-section.

5. A sports racquet having a frame head with an opening therein and a synthetic string mounted on said head to provide a suspended, tensioned grid over said opening for hitting a ball or similar playing object, said string comprising:

a core;

a coating of synthetic material surrounding and bonded to said core; said coating providing said string with an outer surface having a plurality of planar surfaces to give said string a hexagonal cross-section configuration and said coating presenting six parallel, axially extending biting edges peripherally of said string for frictional engagement with said ball or similar playing object to impart spin control thereto.

6. In a sports racquet having a frame head with an opening therein and a synthetic string mounted on said head to provide a suspended, tensioned grid over said opening for hitting a ball or similar playing object, the improvement comprising said string having a hexagonal cross-section and presenting six biting edges peripherally of said string for frictionally engaging said ball or similar playing object to impart spin control thereto.

7. A string as in claim 1, wherein said planes are arranged so that said string has a regular polygonal cross-section.

8. A string as in claim 7, wherein said string has a regular hexagonal cross-section.

9. A method for the production of a synthetic string for a sports racquet, or the like, comprising:

forming an inner core from a multiplicity of twisted and glued fibers;

forming an intermediate layer by helically wrapping said inner core with a plurality of twisted and glued monofilament strands of diameter larger than said fibers; and processing the resulting structure with a coating glue, including passing the same through a die to form a coating of polygonal cross-section extrusion applied to the wrapped inner core.

10. A method as in claim 9, wherein the processing step comprises forming a coating of regular hexagonal cross-section.

* * * * *